US009723906B2

(12) United States Patent
Kim

(10) Patent No.: US 9,723,906 B2
(45) Date of Patent: Aug. 8, 2017

(54) SPUIT-TYPE COSMETIC CONTAINER

(71) Applicant: YONWOO CO., LTD., Incheon (KR)

(72) Inventor: You-Seob Kim, Incheon (KR)

(73) Assignee: YONWOO CO., LTD., Incheon (KR)

( * ) Notice: Subject to any disclaimer, the term of this patent is extended or adjusted under 35 U.S.C. 154(b) by 98 days.

(21) Appl. No.: 14/433,262

(22) PCT Filed: Oct. 2, 2013

(86) PCT No.: PCT/KR2013/008811

§ 371 (c)(1),
(2) Date: Apr. 2, 2015

(87) PCT Pub. No.: WO2014/054882

PCT Pub. Date: Apr. 10, 2014

(65) Prior Publication Data

US 2015/0257510 A1 Sep. 17, 2015

(30) Foreign Application Priority Data

Oct. 4, 2012 (KR) ..... 10-2012-0109822

(51) Int. Cl.
*A45D 34/04* (2006.01)

(52) U.S. Cl.
CPC ..... *A45D 34/041* (2013.01); *A45D 34/045* (2013.01); *A45D 2200/055* (2013.01)

(58) Field of Classification Search
CPC ... A45D 34/041; B01L 3/0217; B01L 3/0282; B01L 3/0224
USPC ..... 401/126
See application file for complete search history.

(56) References Cited

U.S. PATENT DOCUMENTS 3,820,576 A * 6/1974 Torrent ..... B01L 3/0282 141/24
4,955,745 A * 9/1990 Vauquelin ..... A45D 34/045 141/24
5,464,048 A * 11/1995 Allen ..... A61F 9/0008 141/20.5

(Continued)

FOREIGN PATENT DOCUMENTS

FR 2820958 A1 * 8/2002 ..... A45D 34/041
KR 2012-0000358 A 1/2012

(Continued)

OTHER PUBLICATIONS

International Search Report issued in PCT/KR2013/008811 and mailed on on Nov. 26, 2013.

*Primary Examiner* — Jennifer C Chiang
*Assistant Examiner* — Bradley Oliver
(74) *Attorney, Agent, or Firm* — Marshall, Gerstein & Borun LLP

(57) ABSTRACT

The present invention relates to a spuit-type cosmetic container. The spuit-type cosmetic container, according to the present invention, comprises: spiral grooves for guiding the ascending and descending operations of a piston rod on both sides of an inner cap; and guide protrusions which move along the spiral grooves on both sides of the piston rod such that the piston rod ascends and descends along the spiral grooves of the inner cap. Thus, the present invention can prevent a sudden discharge of the content by minimizing the pressure caused by a piston.

4 Claims, 6 Drawing Sheets

(56) References Cited

U.S. PATENT DOCUMENTS

| | | | | |
|---|---|---|---|---|
| 6,045,003 | A * | 4/2000 | Seidler | B01L 3/0224 141/23 |
| 7,534,062 | B2 * | 5/2009 | Ramet | A45D 34/045 401/126 |
| 9,347,811 | B2 * | 5/2016 | Wang | G01F 11/084 |
| 2013/0074983 | A1 * | 3/2013 | Choi | A45D 34/04 141/23 |
| 2014/0234007 | A1 * | 8/2014 | Lee | A45D 34/00 401/121 |

FOREIGN PATENT DOCUMENTS

| | | | |
|---|---|---|---|
| KR | 2012-0014653 | A | 2/2012 |
| KR | 2012-0002205 | U | 3/2012 |
| KR | 10-1154067 | B1 | 6/2012 |

* cited by examiner

SPUIT-TYPE COSMETIC CONTAINER

CROSS-REFERENCE TO RELATED APPLICATIONS

This U.S. non-provisional patent application is a national stage application under 35 U.S.C. §371 of international application PCT/KR2013/008811, filed Oct. 2, 2013, and claims the benefit of priority under 35 U.S.C. §119 of Korean Patent Application No. 10-2012-0109822, filed Oct. 4, 2012, the entire content of which is hereby incorporated by reference for all purposes.

BACKGROUND OF THE INVENTION

Generally, as a method for using liquid-type content such as eye cream, which is desirably used with a small amount but with exactly a fixed amount, individually packing method with as much amount as to be used each time like a capsule has been used traditionally. However, even when a user used content packed in this individually packed method, relatively a good deal of amount of content remained inside the capsule; therefore the method was considered as inefficient.

To solve the problem of this individually packed method, a spuit-type cosmetic container that discharges a fixed quantity to be used by means of a spuit after containing content into the container was suggested.

The existing spuit-type container as above has a structure, wherein a piston rod combined on the lower portion of a button part descends when the button part is pressurized, and simultaneously a piston combined on the lower portion of the piston rod descends and generates inner pressure of a spuit pipe, causing the discharge of content suctioned into the inside of the spuit pipe, and also, because the piston rod is composed to descend perpendicularly, virtual pressure is delivered exactly so to the piston which generates the inner pressure powerfully and causes a sudden discharge of the content; therefore, it leads to a problem that it is not easy for a user to apply content exactly on the wanted area, and thereby causes inconvenience for the user.

SUMMARY OF THE INVENTION

The present description relates to a spuit-type cosmetic container. The spuit-type cosmetic container, according to the present description, comprises: spiral grooves for guiding the ascending and descending operations of a piston rod on both sides of an inner cap; and guide protrusions which move along the spiral grooves on both sides of the piston rod such that the piston rod ascends and descends along the spiral grooves of the inner cap. Thus, the presently described embodiments can prevent a sudden discharge of content by minimizing the pressure caused by a piston.

The present description is devised to solve the said problems above, and its goal is to provide to a spuit-type cosmetic container, wherein spiral grooves which guide descending and ascending a piston rod are formed on the both surface of an inner cap, a guide protrusion which moves along the spiral grooves is formed on both surface of the piston rod, and the piston rod is composed to be able to ascend and descend along the spiral grooves of the inner cap, thereby preventing content from being discharged rapidly by minimizing pressure generated by the piston.

In addition, it is to provide a spuit-type cosmetic container by which content can be applied exactly on the desired area by combining a ball applicator where content is discharged with the lower portion of the spuit pipe.

To solve the problems above, according to the present description, a spuit-type cosmetic container comprising a container body in which content is held and which comprises a coupling part where a first screw thread is provided, encircling outer circumferential surface; a spuit pipe which suctions content contained in the container body; an applicator part which is combined on the lower portion of the spuit pipe and discharges content; an inner cap comprising a body, wherein a second screw thread is coupled on inner circumferential surface with a first screw thread with screw coupling, and an ascending and descending guide part which extends from the end of the body to the upper portion of the body and comprises a pair of spiral grooves provided on both inner circumferential surfaces; an ascending and descending member comprising a piston rod, wherein a piston is coupled so as to guide content to be suctioned or discharged by changing pressure in the spuit pipe of its end while ascending and descending inside of the inner cap, and a guide protrusion built on both outer circumferential surfaces and moving along spiral grooves in the inner cap; a button part which is coupled on the upper portion of the ascending and descending guide member and delivers pressure by a user's pressurizing to the ascending and descending guide member; and an outer cap which is coupled, encircling the inner cap so as to be rotatable, and wherein a hollow cavity is formed and wherein an ascending and descending guide member which guides perpendicular movement of the guide protrusion is coupled.

Furthermore, it is featured that the applicator part comprises a steel ball which contacts a user's skin and discharges content by rotation, and a ball support body which forms space for the steel ball to rotate, and a ball cap which is coupled to the lower portion of the spuit pipe and prevents separation of the steel ball.

Furthermore, it is featured that on both outer circumferential surfaces of the body of the inner cap are coupled a pair of depression protrusions sunken to inner direction so as to limit independent rotation range.

Furthermore, it is featured that inside of the outer cap is provided a pair of rotation protrusion which has a rotational motion inside a pair of the depression grooves.

Furthermore, it is featured that the button part comprises a button which is coupled to the upper portion of the piston rod, and a button cap which is coupled to a hollow cavity and encircles the button, thereby delivering pressure to the button.

Furthermore, it is featured that on the upper end of the spuit pipe is provided a securing part which is secured on the upper end of the coupling part of the container body, and on the lower end of the securing part is provided a gasket.

Described as above, according to the present description, on both sides of the inner cap are coupled spiral grooves which guide ascending and descending the piston rod, and on both sides of the piton rod are coupled guide protrusions that move along the spiral grooves, so that the piston rod is composed to ascend and descend along the spiral grooves; therefore, it is possible to minimize pressure generated by the piston and to prevent content from being discharged rapidly.

Furthermore, it is possible to apply content exactly on the desired area by coupling a ball applicator, where content is discharged, on the lower portion of the spuit pipe.

DETAILED DESCRIPTION OF PREFERRED EMBODIMENTS

Figure 1:
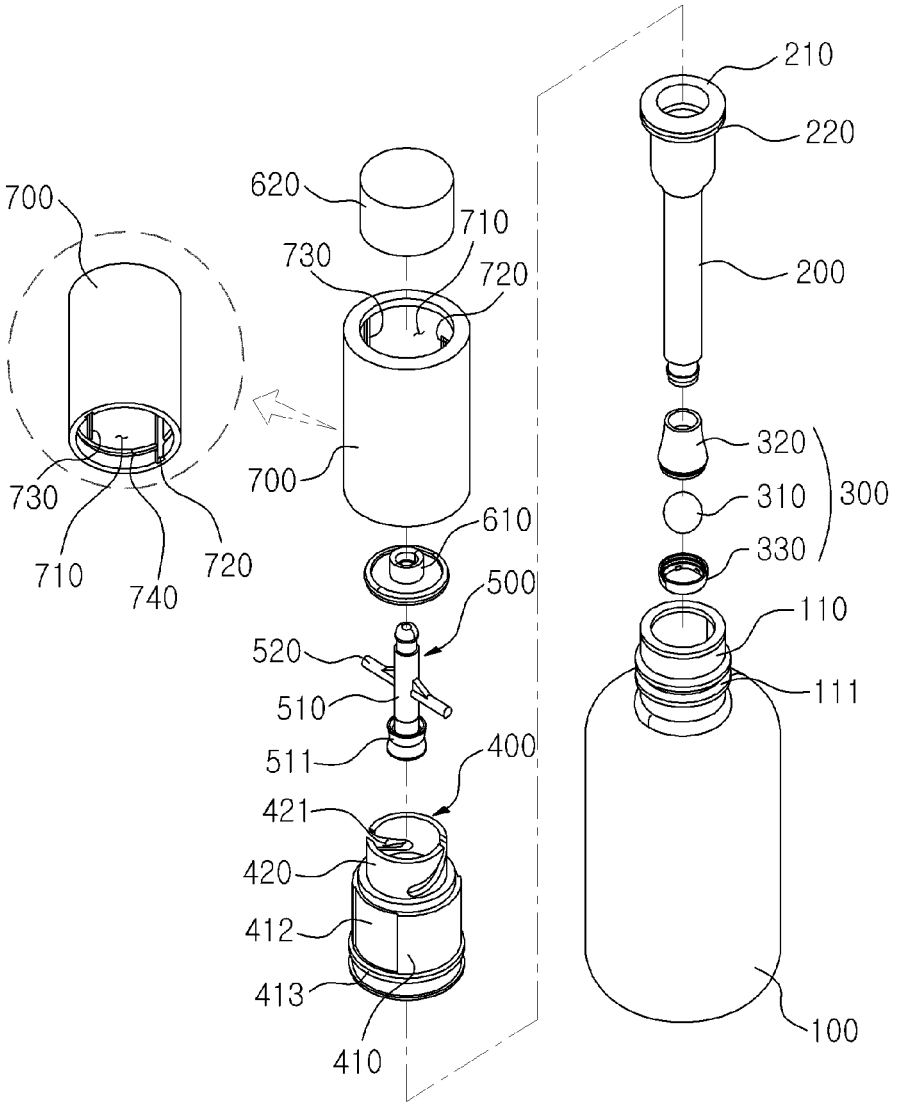
FIG. 1 is an exploded perspective view illustrating a configuration of a spuit-type cosmetic container according to an exemplary embodiment.

Hereinafter, exemplary embodiments will be described in detail with reference to the accompanying drawings. The same reference numerals provided in the drawings indicate the same members.

Figure 2:
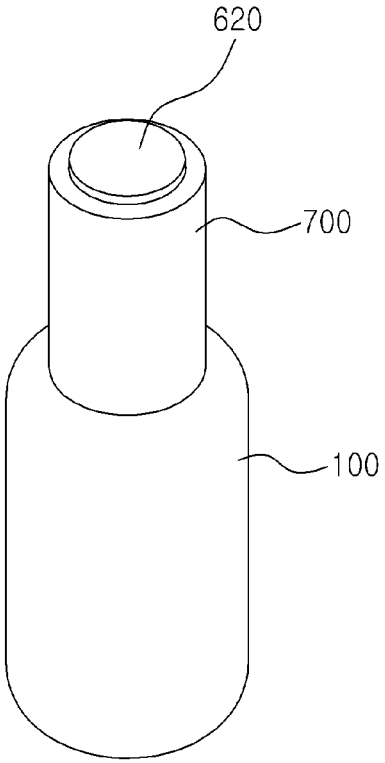
FIG. 2 is an assembled perspective view illustrating a configuration of a spuit-type cosmetic container according to an exemplary embodiment.

FIG. 1 is an exploded perspective view illustrating a configuration of a spuit-type cosmetic container according to an exemplary embodiment; FIG. 2 is an assembled perspective view illustrating a configuration of a spuit-type cosmetic container according to an exemplary embodiment.

Figure 3:
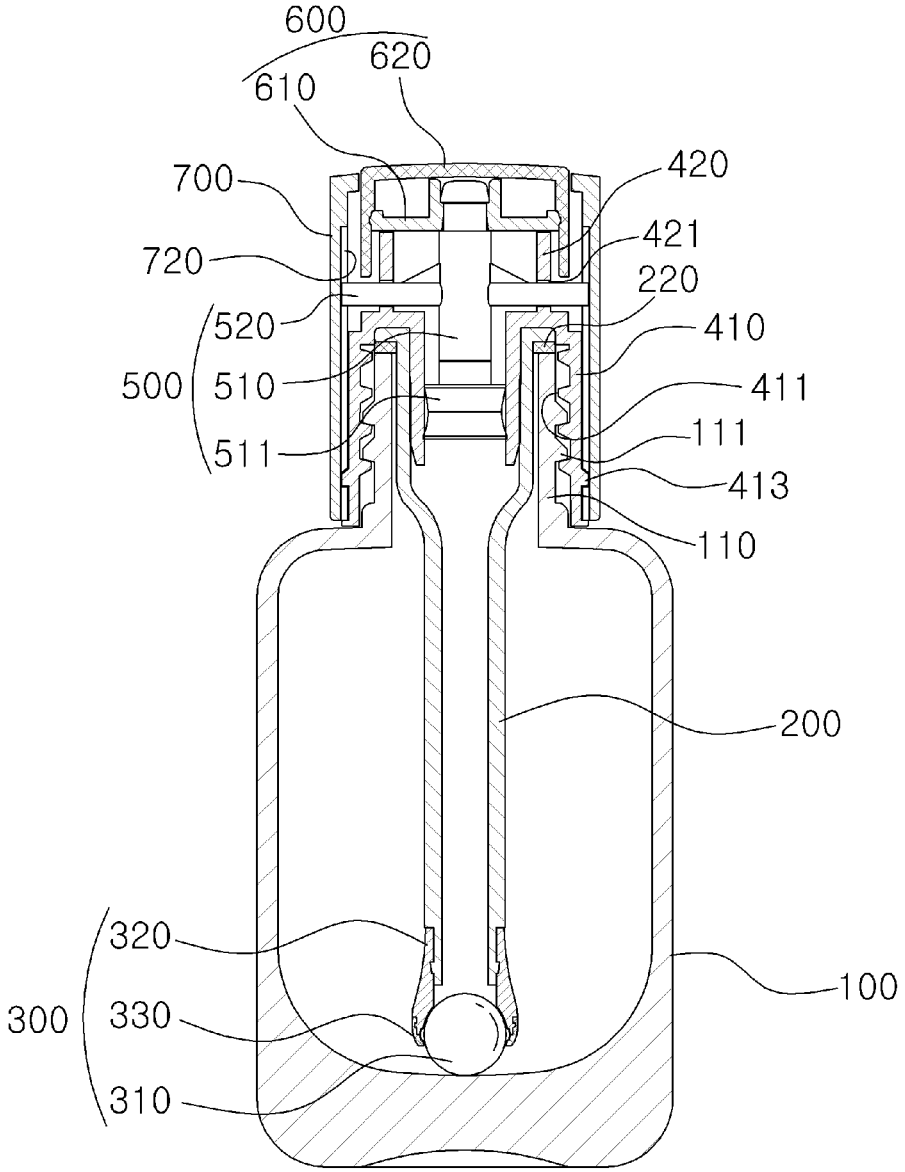
FIG. 3 is a cross-sectional view illustrating a configuration of a spuit-type cosmetic container according to an exemplary embodiment.
Figure 4:
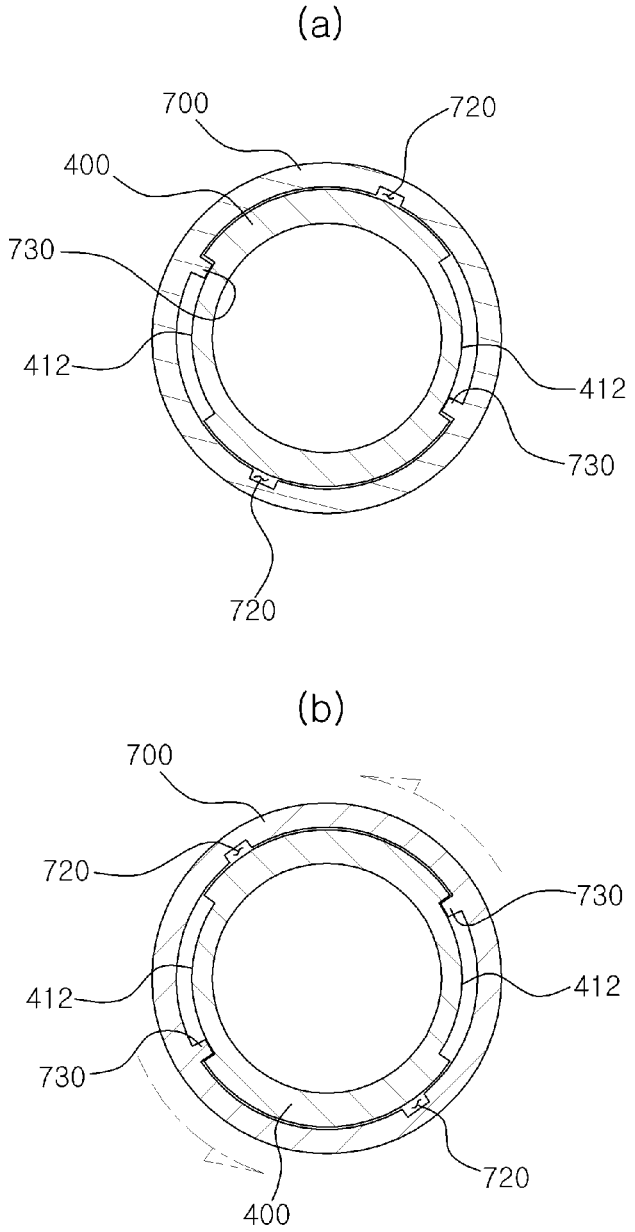
FIG. 4 is an explanatory view illustrating movement state of a rotation protrusion which rotates inside the depression groove of the inner cap upon rotation of the outer cap of a spuit-type cosmetic container according to an exemplary embodiment; and FIG. 5

FIG. 3 is a cross-sectional view illustrating a configuration of a spuit-type cosmetic container according to an exemplary embodiment; and FIG. 4 is an explanatory view illustrating movement state of a rotation protrusion which rotates inside the depression groove of the inner cap upon rotation of the outer cap of a spuit-type cosmetic container according to an exemplary embodiment;

Referring to FIGS. 1 to 4, an explanatory view illustrating according to an exemplary embodiment includes a container body 100, a spuit pipe 200, an applicator 300, an inner cap 400, an ascending and descending member 500, a button part 600, and an outer cap 700.

The said container body 100 holding contents comprises a coupling part 110 which equips a first screw thread 111, encircling the outer circumferential surface so that the inner cap 400, which will be described later, is coupled.

The said spuit pipe 200 suctions content contained in the container body 100, and it is preferable that on the upper end of the spuit pipe 200 is provided a securing part 210 which secures on the upper end of the coupling part 110 of the container body 100, and on the lower end of the securing part 210 is provided a gasket 220 which prevents content held in the container body 100 from being discharged and prevents the spuit pipe 200 from being broken.

The applicator 300 is coupled to the lower portion of the spuit pipe 200 and discharges content, comprising a steel ball 310 which is contacted on a user's skin and discharges content by rotation, a ball support body 320 which is coupled to the lower portion of the spuit pipe 200 and forms a space for rotation of the steel ball 310, and a ball cap 330 which is coupled to the end of the ball support body 320 and prevents separation of the steel ball 310.

The inner cap 400, which is coupled with screw coupling to the coupling part 110 of the container body 100 and guides ascending and descending the ascending and descending guide member 500, comprises a body 410 and an ascending and descending guide part 420.

The body 410, encircling the coupling part 110 of the container body 100 and coupled with screw coupling, comprises a 2nd screw thread 411 which is coupled with the first screw thread 111 on the inner circumferential surface.

In various embodiments, it is featured that on both inner circumferential surfaces are provided a pair of depression grooves 412 which are depressed to inner surface direction. The depression parts 412, on which a rotation protrusion 730 to be described is provided, limit rotation range of an outer cap 700 by means of both ends of the depression parts 412 when the outer cap 700 rotates.

The depression parts 412 form a space for independent rotation of the outer cap 300 when the outer cap 300 rotates under the state of the inner cap 400 being couples to the container body 100, thereby causing ascent of the ascending and descending member 500 that will be described later.

On the other hand, it is preferable that on the outer circumferential surface of the body 400 is provided a coupling protrusion 413 which encircles the outer circumferential surface so as to make coupling with the outer cap 700 possible.

The ascending and descending guide part 420 form a tubular shape which extends to the upper part on the upper end of the body 410, and in at least some of the presently described embodiments, it is featured that a pair of spiral grooves 421 are provided to guide ascending and descending the ascending and descending member 500 on both outer circumferential surfaces of the ascending and descending guide part 420.

The spiral grooves 421 guides guide protrusions 520 to move along the spiral grooves 421 when the ascending and descending member 500 descends by a button part 600 pressurizing, thus controlling descending speed of the ascending and descending member 500 and thereby preventing content from being discharged rapidly.

The ascending and descending member 500 which is coupled to the button part 600 and ascends and descends inside the inner cap 400 according to the ascending and descending operation, thus changing the pressure in the spuit pipe 200 and inducing the content to be suctioned or discharged, includes a piston rod 510 and guide protrusions 520.

The piston rod 510 is coupled to a button 610 and ascends and descends according to the ascending and descending operation of the button 610, wherein on the lower portion of the piston pipe 510 is coupled a piston 511 which ascends and descends as being contacted tightly to the inner wall of the inner cap 400, and changes the pressure in the spuit pipe 200 and thus induces content to be suctioned and discharged.

The guide protrusions 520 are provided with protrusion on both outer circumferential surfaces, wherein it is featured that in the present invention, the guide protrusion 520 are composed to move along the spiral grooves 421 of the inner cap 400.

The guide protrusions 520 move along the spiral grooves 421, control descending speed when the ascending and descending member 500 descends according to pressurization of the button part 600, and thereby minimizes pressure generated by the piston 511 and prevents content from being discharged rapidly.

The button part 600 is coupled to the upper portion of the ascending and descending member 500 and delivers pressure caused by a user's pressurizing to the ascending and descending member 500, comprising a button 610 which is coupled to the upper portion of the piston rod 510 and a button cap 620 which is coupled to a hollow cavity of the outer cap 700 that will be described later and delivers pressure to the button 610 by encircling the button 610 and provided to the button 620.

The outer cap 700 is coupled to be able to rotate, encircling the inner cap, also comprising a hollow cavity 710 for the button cap 620 to be coupled and a coupling groove 740 which is coupled to the coupling protrusion 413 of the inner cap 400 on the inner circumferential surface.

In this present embodiments, it is featured that a perpendicular guide groove 720 is provided on the inner circumferential surface of the outer cap 700 where the guide protrusion 520 is inserted for the guide protrusion 520 to move perpendicularly, wherein the perpendicular guide groove 720 guides the guide protrusion 520 to move along the spiral grooves 421 when the outer cap 700 rotates independently.

On the other hand, it is featured that on the inner surface of the outer cap 700 are provided a pair of rotation protrusions, wherein the pair of rotation protrusions are secured on both end of the depression parts when the outer cap 700 rotates, thus limiting independent rotation range of the outer cap 700; meanwhile, when secured on both ends of the depression parts, the pair of rotation protrusions guide the inner cap 400 to be rotated with the outer cap 700 together.

In the following, referring to FIG. 5 and FIG. 6, a method of use of a spuit-type cosmetic container according to an exemplary embodiment is explained.

Figure 5:
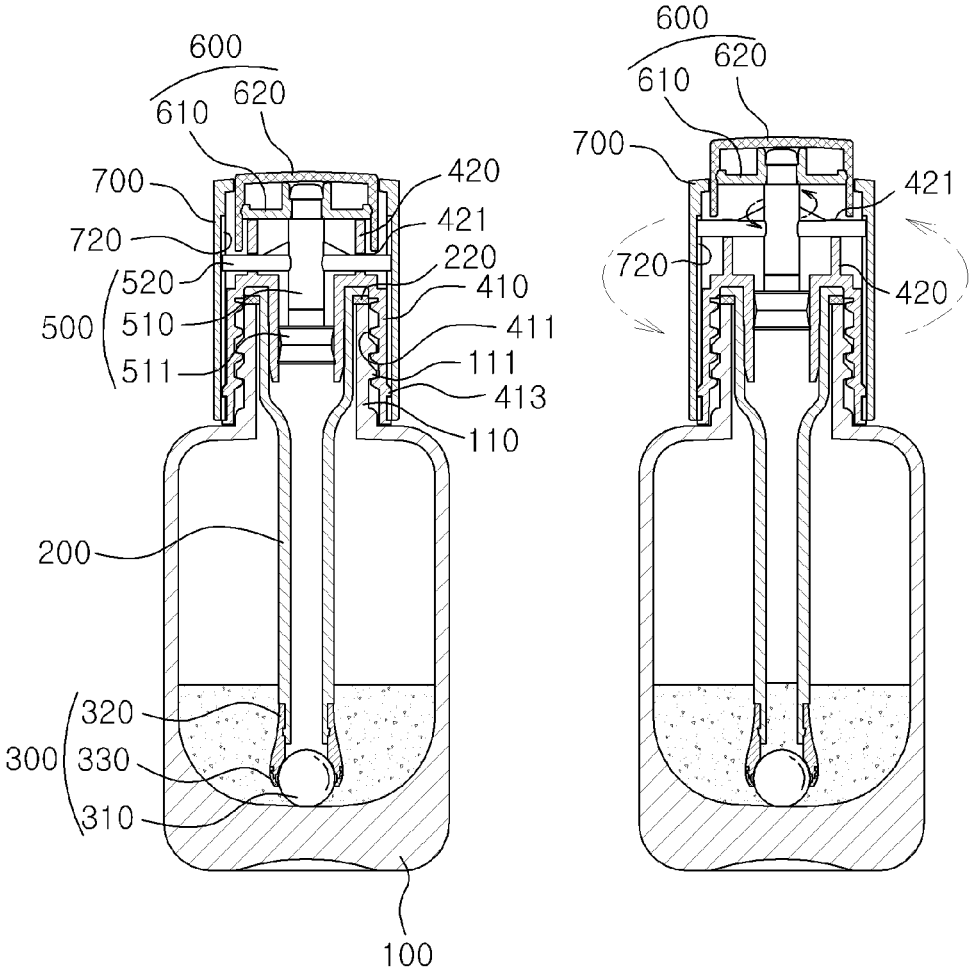
Figure 6:
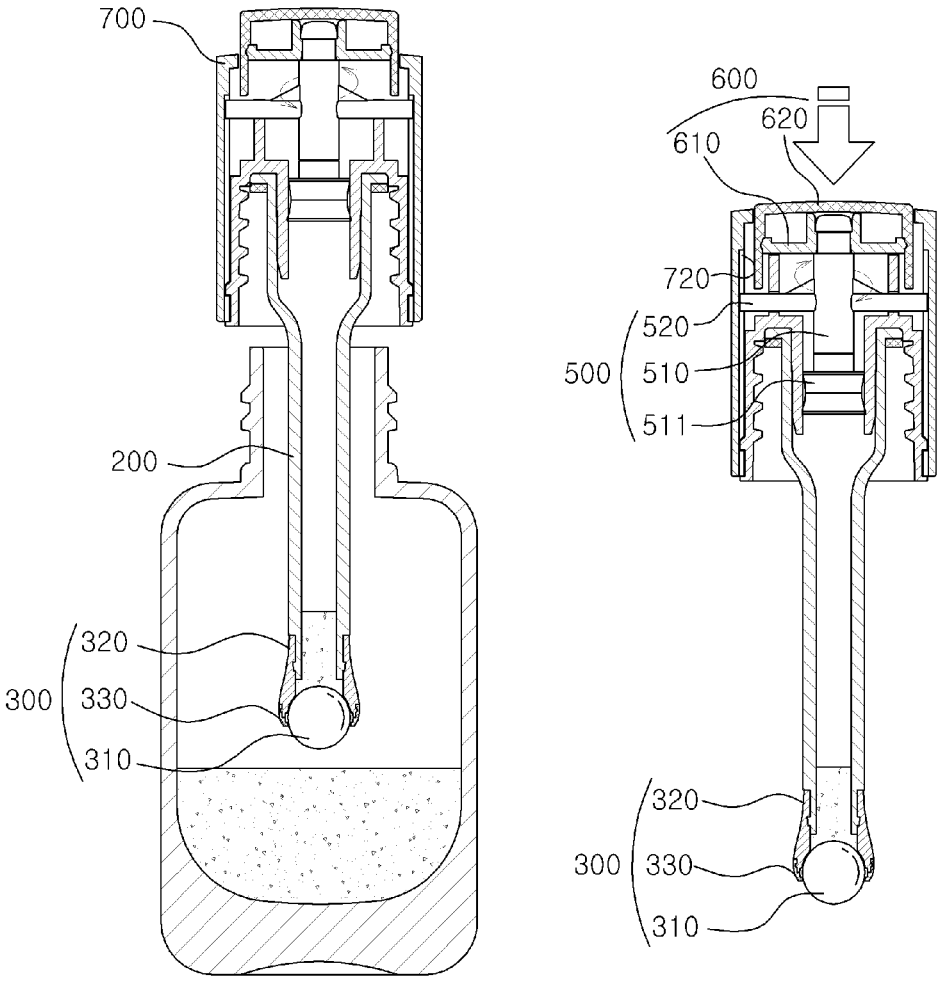
FIG. 6 is an explanatory view illustrating a method of use of a spuit-type cosmetic container according to an exemplary embodiment.

FIG. 5 and FIG. 6 are explanatory views illustrating a method of use of a spuit-type cosmetic container according to an exemplary embodiment. Referring FIG. 5 and FIG. 6, a spuit-type cosmetic container according to an exemplary embodiment of the present invention has a structure, wherein in a state that the inner cap 400 and the outer cap 700 are coupled on the upper portion of the container body 100, if a user rotates the outer cap 700 to one side until the rotation protrusion 730 located on one end of the depression part 412 gets to be secured on the other end of the depression part 412, rotation of the outer cap 700 is performed. As shown above, when independent rotation of the outer cap 700 is performed, the guide protrusion 520 of the ascending and descending member 500 inserted into the perpendicular guide groove 720 of the outer cap 700 ascends along the spiral grooves 421 of the inner cap 400 and thereby leads to the ascent of the piston 500 with the ascending and descending member 500 moving together.

As show above, when the piston 500 ascends, content is suctioned to the inside of the spuit pipe 200 by its pressure; at this time, the button part 600 coupled on the upper portion of the ascending and descending member 500 moves upwards as the ascending and descending member 500 ascends.

Next, after the independent rotation of the outer cap 700 is performed, that is to say, when rotation protrusions 730 which has been located on one end of the depression parts 412 is secured on the other end of the depression parts 412, whereafter the rotation of the inner cap 400 is performed with the rotation of the outer cap 700, and thereby the inner cap 400 and the outer cap 700 are separated, thus leading to separation of the inner cap 400 from the outer cap 700

After a user grips the outer cap 700 and separates the inner cap 400 from the container body 100, it is possible to use content discharged through the applicator 300 by pressurizing the button part 600. At this time, when the button part 600 is pressurized, it is possible to limit descending speed of the ascending and descending member 500 not by making the ascending and descending member 500 descend perpendicularly directly, but by making the guide protrusion rotate along the spiral grooves and descend. Therefore, it is possible to minimize the pressure generated by the piston 511 and prevent content held in the spuit pipe 200 from being discharged rapidly, thereby making it possible to apply content exactly on desired area through the applicator part 300.

Optimal embodiments have been disclosed in the drawings and the specification. Although specific terms have been used herein, these are only intended to describe the present embodiments and are not intended to limit the meanings of the terms or to restrict the scope of the present invention as disclosed in the accompanying claims. Therefore, those skilled in the art will appreciate that various modifications and other equivalent embodiments are possible from the above embodiments. Accordingly, the scope of the present inventions should be defined by the technical spirit of the accompanying claims.

What is claimed is:

1. A spuit-type cosmetic container comprising:

a container body, wherein content is contained, and wherein a coupling part equipping a first screw thread which encircles outer circumferential surface on the upper portion is provided;

a spuit pipe suctioning content held in the container body;

an applicator part coupled on the lower portion of the spuit pipe and discharging content;

an inner cap comprising a body, wherein a second screw thread couples with screw combination to the first screw thread of the container body on the inner circumferential surface, and an ascending and descending guide part which extends from the upper end to the upper portion of the body and comprises a pair of spiral grooves on both outer circumferential surfaces;

an ascending and descending member, further comprising a piston rod, wherein a piston is coupled so as to guide content to be suctioned or discharged by changing pressure in the spuit pipe of its end while ascending and descending inside of the inner cap, and a guide protrusion built on both outer circumferential surfaces and moving along spiral grooves in the inner cap;

a button part, coupled to the upper portion of the ascending and descending member and delivering pressure by a user's pressurizing to the ascending and descending member; and an outer cap coupled to be able to rotate, encircling the inner cap, comprising a hollow cavity, and forming a perpendicular guide groove at an inner circumferential surface thereof which guides a perpendicular movement of the guide protrusion, wherein a pair of depression parts, sunken to the inner side direction, are formed at both sides of an outer circumferential surface of the body of the inner cap to be able to limit an independent rotation range of the outer cap, and wherein a pair of rotation protrusions are formed at an inner side of the outer cap, the rotation protrusions rotatable inside the depression parts.

2. The spuit-type cosmetic container of claim 1, wherein the applicator part further comprises:

a steel ball touching a user's skin and discharging content by its rotation;

a ball support body coupled to the lower portion of the spuit pipe and forming space for the steel ball to rotate; and a ball cap coupled to the end of the ball support body and preventing the steel ball from being separated.

3. The spuit-type cosmetic container of claim 1, wherein the button part comprises:

a button coupled to the upper portion of the piston rod; and a button cap coupled to the hollow cavity of the outer cap, and built as encircling the button, and delivering pressure to the button.

4. The spuit-type cosmetic container of claim 1, wherein a securing part secured on the upper end of the container body is built on the upper end of the spuit pipe, and a gasket is coupled on the lower end of the securing part.

* * * * *